US008821358B1

(12) United States Patent
Werner

(10) Patent No.: US 8,821,358 B1
(45) Date of Patent: Sep. 2, 2014

(54) INERTIAL EXERCISE DEVICE

(76) Inventor: Gary V. Werner, Appleton, WI (US)

( * ) Notice: Subject to any disclaimer, the term of this patent is extended or adjusted under 35 U.S.C. 154(b) by 109 days.

(21) Appl. No.: 13/374,657

(22) Filed: Jan. 6, 2012

(51) Int. Cl.
*A63B 21/22* (2006.01)

(52) U.S. Cl.
USPC ..... 482/110

(58) Field of Classification Search
USPC ..... 482/44–46, 50, 92, 110, 121–122, 126, 482/148; 446/236, 247, 253
See application file for complete search history.

(56) References Cited

U.S. PATENT DOCUMENTS

| | | | | |
|---|---|---|---|---|
| 1,604,333 | A * | 10/1926 | Anderson | 482/46 |
| 3,672,094 | A * | 6/1972 | Vigorito | 446/253 |
| 3,737,162 | A * | 6/1973 | Wood | 482/110 |
| 4,953,854 | A * | 9/1990 | Pizur, Sr. | 482/148 |
| 5,512,028 | A * | 4/1996 | Sparks, III | 482/92 |
| 5,624,294 | A * | 4/1997 | Chen | 446/253 |
| 5,674,159 | A * | 10/1997 | Davidson | 482/92 |
| 6,740,013 | B2 * | 5/2004 | Werner | 482/110 |
| 6,939,193 | B1 * | 9/2005 | McDowell et al. | 446/153 |
| D579,991 | S * | 11/2008 | Arnstein | D21/694 |
| 2002/0065175 | A1 * | 5/2002 | Walker | 482/93 |
| 2006/0168785 | A1 * | 8/2006 | Kraft et al. | 24/715.3 |
| 2007/0149368 | A1 * | 6/2007 | Koch | 482/131 |

FOREIGN PATENT DOCUMENTS

| | | | |
|---|---|---|---|
| WO | WO 8903714 A1 * | 5/1989 | A63H 1/32 |

OTHER PUBLICATIONS http://www.curlylaces.com/index.html.*
"Shoelaces." Mar. 11, 2009. <http://vbulletin.thesite.org/showthread.php/138385-Straight-or-crossed-laces>.*

* cited by examiner

*Primary Examiner* — Stephen Crow
*Assistant Examiner* — Garrett Atkinson
(74) *Attorney, Agent, or Firm* — Richard W Tanzer

(57) ABSTRACT

This invention is for a starting apparatus for an inertial pendulum. The apparatus is provided with elastic strands twisted about each other and inelastic strands wound about the twisted strand and the ends of the strands are secured to each other so that when one end of the strands is attached to an inertial element and tension is applied to the other end the strands are caused to untwist and the inertial element caused to rotate.

4 Claims, 2 Drawing Sheets

INERTIAL EXERCISE DEVICE

BACKGROUND OF THE INVENTION

1. Field of the Invention

This invention relates to inertial exercise apparatus and to inertial recreational apparatus which employ the principals of an inertial pendulum to provide the resistance for exercise and recreation apparatus.

More specifically this invention relates a starting mechanism for the above described apparatus that enables the user to set the apparatus in motion without preparatory winding.

2. Background of the Invention

The apparatus of this invention has its origins in the button and string amusement device that has been known to be in use since buttons have been known. A strand of string is looped through two holes in the button and tied in a loop. The ends of the loop are placed around the thumbs of the user and the button is rotated to cause the loop to wind on either side of the button. The thumbs exert tension on the string and the wound string is caused to unwind. The inertia of the button causes the string to unwind and then to wind in the opposite direction. When the inertia of the button is spent tension is again applied to the string and the button is caused to rotate in the opposite direction. With a little practice a child can keep the button and string inertial pendulum cycling for as long as the arms and thumbs can hold up.

In more recent times inertial pendulum devices have been found to be convenient exercise devices for use in office and travel situations. Imaginative users of inertial pendulum devices have found ways to employ the inertial pendulum in many of the exercises that are customarily performed with free weights and with resilient resistance apparatus.

To perform some of these exercises it is difficult to pre-wind the inertial pendulum and then get in a position to perform the exercise.

It is an object of this invention to provide starting apparatus for inertial pendulums that is self pre-winding.

It is further an object of this invention to provide the apparatus described above wherein the apparatus is incorporated into the structures of an inertial pendulum making the inertial pendulum self starting.

Other objects will be made apparent from the specifications, drawings and claims.

DISCUSSION OF PRIOR ART

Heretofore, art has not provided a starter means other than pre-winding for inertial pendulums.

The prior art provides numerous exercise and amusement devices that employ the inertial pendulum as the dynamic element of the devices.

The inventor's own U.S. Pat. No. 6,740,013 discloses one such exercise and amusement device.

BRIEF DESCRIPTION OF THE INVENTION

The invention in its simplest form is a starter apparatus for inertial pendulums comprising; at least one pair of elastic strands and at least one pair of inelastic strands of approximately the same length wherein, one end of the strands is joined together, and the elastic strands are wound about each other and stretched until they are approximately parallel to each other and parallel to the inelastic strands and the other end of the strands are joined together, so that when the elastic strands return to their relaxed state they are again wound about each other and the inelastic strands are wound about the elastic strands.

The most common use for the apparatus of this invention is to employ two starter apparatuses of this invention, one to each side of an inertial body, to create an inertial pendulum.

DETAILED DESCRIPTION OF THE INVENTION

Figure 1:
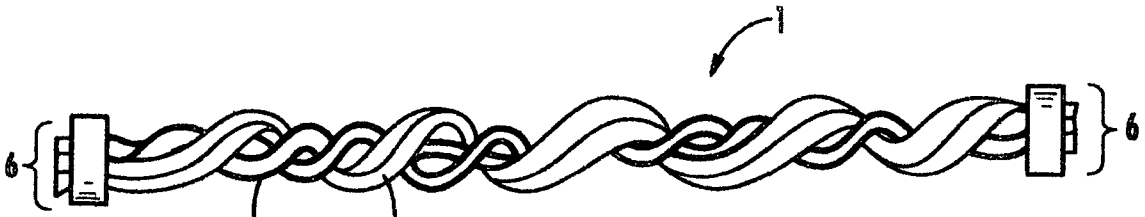
FIG. 1 is an elevation view of the starting apparatus of this invention.

In the drawings, like numbers refer to like objects and the proportions of some details have been modified and some structures have been shown schematically to facilitate illustration.

An inertial pendulum oscillates an inertial body by applying tension to twisted strands connected to the inertial body which causes the inertial body to rotate about the strands and the strands to untwist. The tension is then relaxed permitting the inertial body to twist the strands in the opposite direction. When the inertial body's energy is spent, tension is again applied to the strands causing the twisted strands to unwind in the opposite direction. The cycles of winding and unwinding are repeated, providing exercise and entertainment for the user.

Heretofore the procedure for starting a torsion pendulum has been to twist the strands about each other and then to apply tension to the strands and to try to introduce enough inertia into the inertial body so that the number of twist generated from the first cycle is greater than the number of twists provided for starting. A few cycles where the number of twist in each successive cycle is greater than the number of twists generated by the previous cycle will enable the user to establish a rhythm to maintain equal oscillations.

As the benefits of an exercise program incorporating the use of an inertial pendulum as a resistance element have become widely known, applications where the winding of the strands preparatory to starting of some exercises were found to be difficult and in some application not practical. The starting apparatus of this invention when incorporated into the structures of an inertial pendulum enable the beginner to learn to operate the pendulum more easily as well as providing an inertial pendulum for use in situations where pre-winding is difficult or is not practical.

Figure 2:
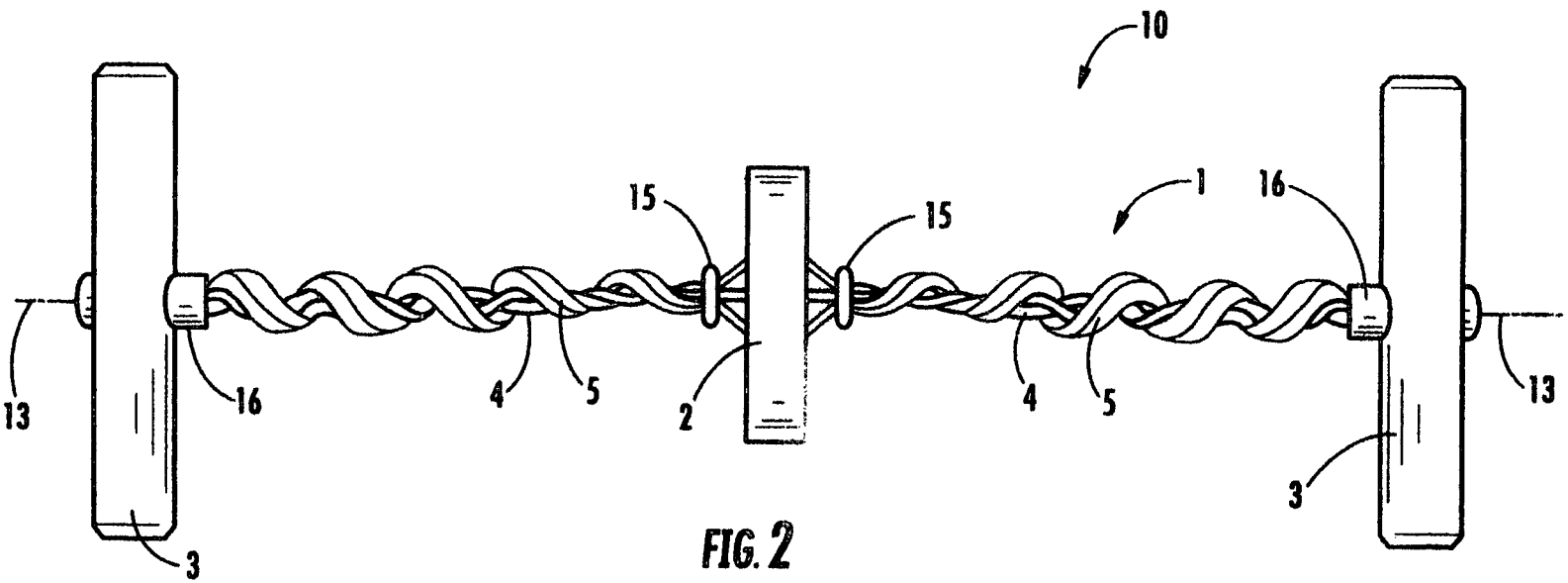
FIG. 2 is an elevation view of the starting apparatus of this invention incorporated into the structures of an inertial pendulum.
Figure 3:
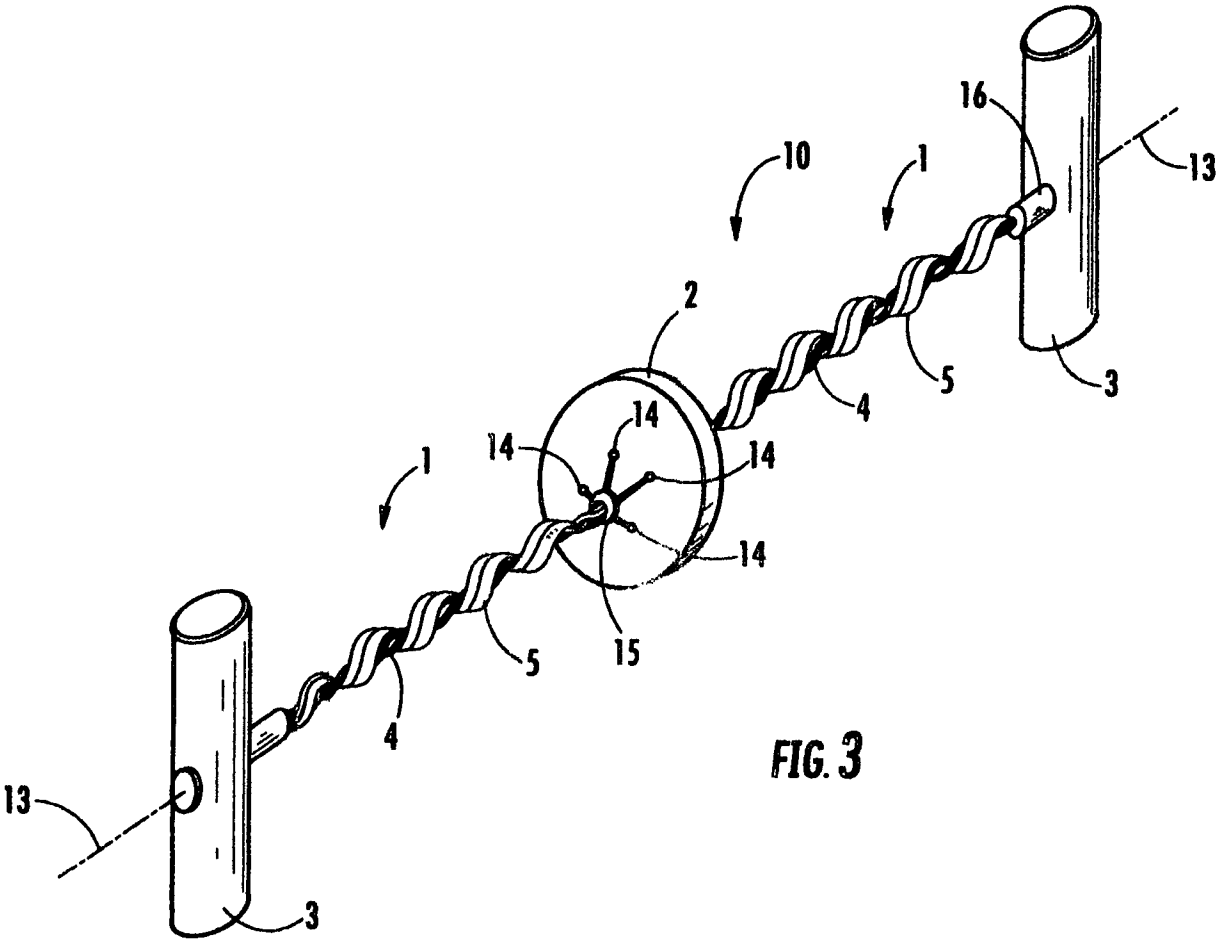
FIG. 3 is a pictorial view of the inertial pendulum of FIG. 2.

Referring now to FIGS. 1-3, inertial pendulums 10 incorporating this invention will typically have a starting apparatus 1 attached to each side of an inertial body 2. FIGS. 2 and 3 show the free ends of apparatus 1 attached to grips 3 which is a typical configuration of an inertial pendulum used for exercise or for amusement. It should be understood that an inertial pendulum incorporating this invention could have one end anchored and the other end manipulated by hand or through a linkage or the inertial pendulum could have both free ends manipulated by linkages.

Referring now to FIGS. 1 and 2, the apparatus 1 for inertial pendulum 10 comprises: at least one pair of elastic strands 4, at least one pair of inelastic strands 5 approximately the same length as the elastic strands 4 and wherein the elastic strands 4 are wound about each other and wherein the inelastic strands 5 are wound about the elastic strands 4 and the direction of winding of the inelastic strands 5 is the same as the direction of winding of the elastic strands 4, and ends 6 of strands 4 and 5 are joined together by clips 15, 16 to form starting apparatus 1. It should be understood that the means of joining strands 4 and 5 together need not be limited to clips 15, 16 and that joining means such as o-rings, knots, adhesive and fusion also have been found to serve the joining function for strands 4 and 5.

The above disclosures are enabling and would permit one skilled in the art to make and use the starting apparatus of this invention without undue experimentation. The applicant's duty to disclose the best mode of practicing the invention requires that the applicant disclose the configuration of the elements of the invention that produce the optimal results in an inertial pendulum that incorporates the starting apparatus of this invention.

In an inertial pendulum incorporating the starting apparatus of this invention as tensions cause the elastic strands and the inelastic strands to unwind and the inertial body's rate of rotation to accelerate, when the inelastic strands are fully unwound and reach parallel, if the inelastic strands do not also reach parallel, the rotation of the inertial body will be retarded, If the inelastic strands reach parallel while there is still winding in the elastic strands energy will be taken from the inertial body to complete the unwinding of the elastic strands. If the elastic strands reach parallel before the inelastic strands do, the tension in the elastic strands being maintained until the inelastic strands reach parallel will retard the rotation of the inertial body.

Therefore optimal performance of the starting apparatus will be achieved when the elastic and inelastic strands reach parallel simultaneously.

Therefore, the best mode of practicing the invention is to assemble the starting apparatus 1 with at least one pair of elastic strands 4 and at least one pair of inelastic strands 5 of approximately the same length wherein, one end of the strands 4 and 5 is joined together, and the elastic strands 4 are wound about each other and stretched until they are approximately parallel to each other and parallel to the inelastic strands 5 and the free ends of strands 4 and 5 are joined together, so that when the elastic strands 4 return to their relaxed state they are again wound about each other and the inelastic strands 5 are wound about the elastic strands 4.

Referring now to FIGS. 2 and 3 wherein an inertial pendulum 10 is shown in a configuration that is commonly used for exercise and amusement.

Inertial body 2 has a center of mass and an axis of rotation 13 passing through the center of mass and at least two pairs of passages 14 passing through the inertial body and parallel to the axis of rotation 13 and spaced apart an equal distance from the axis of rotation 13 and having one passage 14 on each side of the axis of rotation 13 and intersecting a line passing through and perpendicular to the axis of rotation 13, at least one pair of elastic strands 4 passing through a first pair of passages 14 and elastic strands 4 extend an equal distance to each side of inertial body 2, and at least one pair of inelastic strands 5 passing through a second pair of passages 14 and the inelastic strands 5 extend an equal distance to each side of inertial body 2, o-rings 15 surrounding the elastic strands 4 and inelastic strands 5 and positioned one each side of the inertial body 2 and near to the inertial body 2 so as to secure elastic strands 4 and inelastic strands 5 to each other, and wherein the elastic strands 4 are wrapped around each other and stretched until they are approximately parallel to each other and parallel to inelastic strands 5 and the free ends of the elastic strands 4 and the inelastic strands 5 are joined to each other and elastic strands 4 are relaxed to permit them to return to the relaxed and wrapped configuration to form a self starting inertial pendulum 10.

Tension can be applied to inertial pendulum 10 at both ends either by hand or through linkages or other apparatus. Alternatively one end of pendulum 10 can be anchored to a structure and tension applied at only one end of pendulum 10.

In FIGS. 2 and 3 inertial pendulum 10 is shown to be provided with generic grips 3. It should be understood that the form given to grips 3 is determined by the application to which pendulum 10 is applied and the mode of operation of pendulum 10.

The applicant's duty to disclose the best mode of practicing the invention necessitates the disclosure that in applications such as curl type exercises wherein the tension in the strands is sometimes applied at an angle to the axis of revolution of the inertial body friction and sharp bending around the entrance of the strands into the grips 3 can lead to early wear and breaking of the strands. As shown in FIGS. 2 and 3 a flexible sleeve 16 will serve to reduce damage to the strands and extend the life of starting apparatus 1.

Numerous embodiments of the invention have been disclosed above. The invention admits of many more embodiments. The full disclosure of these embodiments and their variants would greatly multiply the drawings and claims and cause the specifications to become prolix. Therefore, the scope of the invention should not be limited to the scope of the disclosed embodiments. The scope of this invention should only be limited by the scope of the appended claims and all equivalents thereto that would be made apparent thereby to one skilled in the art.

What is claimed is:

1. A starter apparatus for inertial pendulums comprising;

a) at least two elastic strands and at least two inelastic strands, each of the elastic strands and inelastic strands being approximately the same length, and each of the strands having a first end and a second end, wherein, b) the first ends of each of the elastic strands and inelastic strands are joined together;

c) the elastic strands are wound about each other, and stretched, and the inelastic strands are approximately parallel to each other and to the wound elastic strands;

d) the second ends of each of the elastic strands and inelastic strands are joined together, so that when tension is removed from the elastic strands and inelastic strands the elastic strands are again wound about each other and the inelastic strands are wound about the elastic strands; and wherein the joined first ends of the elastic strands and inelastic strands are secured in a first gripping structure and the joined second ends of the elastic strands and inelastic strands are secured in a second gripping structure.

2. The starter apparatus of claim 1 attached to an inertial pendulum.

3. An inertial pendulum starter apparatus, the apparatus comprising;

a) an inertial body having a center of mass and an axis of rotation passing through the center of mass and at least four passages passing through the inertial body and parallel to the axis of rotation and spaced apart an equal distance from the axis of rotation and having one passage on each side of the axis of rotation and intersecting a line passing through and perpendicular to the axis of rotation, b) at least one pair of elastic strands passing through a first pair of passages, and at least one pair of inelastic strands passing through a second pair of passages; wherein c) each of the elastic strands and inelastic strands has a first end, a second end, and a midsection; and each of the elastic strands and inelastic strands extend an approximately equal distance to each side of the inertial body;

d) o-rings surrounding portions of the midsections of the elastic strands and inelastic strands, wherein the o-rings are positioned on either side of the inertial body and near to the inertial body so as to secure the elastic strands and the inelastic strands to each other; and e) wherein, when tension is applied to the first end and the second end of each elastic strand, the elastic strands are wrapped around each other and stretched and the inelastic strands are approximately parallel to each other and parallel to the elastic strands;

f) the first ends of the elastic strands and the inelastic strands are joined together, and second ends of the elastic strands and the inelastic strands are joined together; and g) wherein when tension is relieved from the first end and the second end of each strand, the elastic strands assume a relaxed and wrapped configuration, with the inelastic strands wrapped about the elastic strands, and the inertial pendulum is twisted; and wherein the joined first ends of the elastic strands and inelastic strands are secured in a first gripping structure and the joined second ends of the elastic strands and inelastic strands are secured in a second gripping structure.

4. The inertial pendulum starter apparatus of claim 3 wherein the joined first ends of the elastic strands and the inelastic strands are each provided with a flexible sleeve; and the joined second ends of the elastic strands and the inelastic strands are each provided with a flexible sleeve.

* * * * *